United States Patent [19]

Weber

[11] 4,334,621

[45] Jun. 15, 1982

[54] HOLDER

[76] Inventor: Girard M. Weber, 221 Dutch Sq., Columbia, S.C. 29210

[21] Appl. No.: 81,834

[22] Filed: Oct. 4, 1979

Related U.S. Application Data

[63] Continuation of Ser. No. 956,615, Nov. 1, 1978, abandoned.

[51] Int. Cl.[3] ..... A47F 5/08

[52] U.S. Cl. ..... 211/60 M; 211/89

[58] Field of Search ..... 211/60 M, 89, 60 R, 211/60 T, 66, 60 A. 65; 248/205 A, 314; 131/257; 24/257 R

[56] References Cited

U.S. PATENT DOCUMENTS

| | | | |
|---|---|---|---|
| 1,972,532 | 9/1934 | McMillan | 211/65 |
| 2,161,855 | 6/1939 | Copell | 211/60 M X |
| 2,519,035 | 8/1950 | Esty | 85/21 X |
| 2,522,477 | 9/1950 | Wexberg et al. | 211/60 M X |
| 3,350,045 | 10/1967 | Mayers | 248/205 A |

FOREIGN PATENT DOCUMENTS

| | | | |
|---|---|---|---|
| 440856 | 10/1948 | Italy | 211/89 |
| 245629 | 8/1947 | Switzerland | 211/89 |

*Primary Examiner*—Ramon S. Britts
*Assistant Examiner*—Robert W. Gibson, Jr.
*Attorney, Agent, or Firm*—Larry Harold Kline

[57] ABSTRACT

A device is disclosed, which attaches to a flat surface, for holding small objects which comprises a vertical surface, a horizontal surface secured to the vertical surface, an opening in the horizontal surface, an insert placed in the opening and a bottom opening in the insert to secure any one of the small objects onto the device.

8 Claims, 4 Drawing Figures

FIG. 1
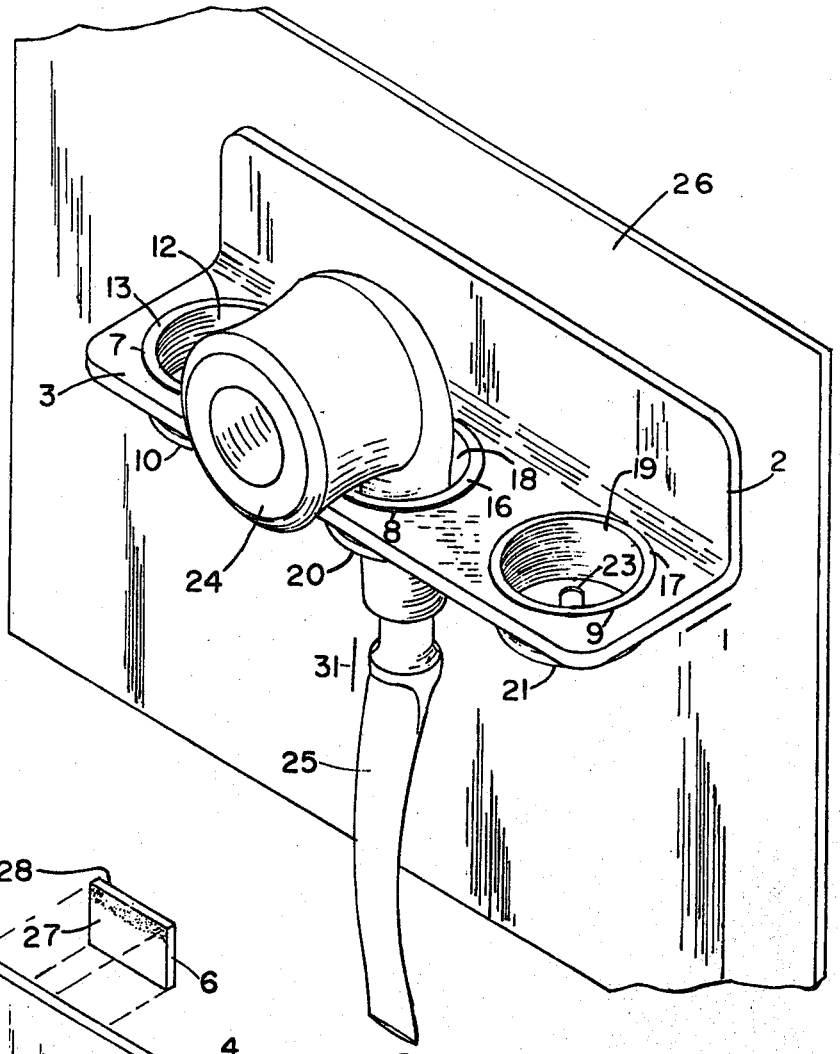
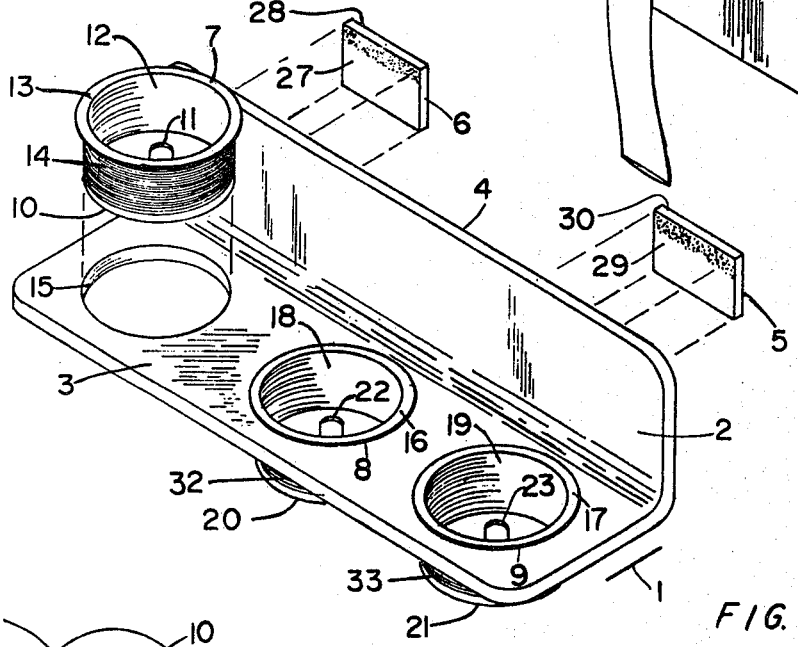
FIG. 2
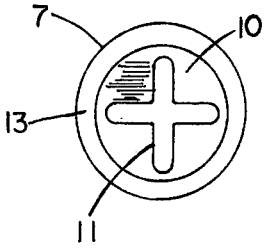
FIG. 3

HOLDER

This is a continuation of application Ser. No. 956,615 filed Nov. 1, 1978, now abandoned.

This invention relates to a holder for pipes and more particularly to a holder which can be either permanently or temporarily attached to a surface.

Pipe smokers frequently need a place to store their pipes, or other small objects, when the pipe smokers are in various locations. The present invention is suitable to hold pipes, or other small objects, in any vehicle, such as a car, boat, truck, off-the-road vehicle, tractor, four-wheel drive vehicle, etc. The device can be utilized on any surface, such as may be found in the home or office.

When a pipe stem is exposed to high temperatures and moisture has accumulated in the stem, the stem may lose its shape because of its exposure to the high temperatures. A pipe may also have a bad taste in the stem due to the accumulation of moisture. Features to solve these problems are contained in the present application.

An object of the present invention is to provide a holder for pipes which will hold the pipe secure enough in a vehicle so that the pipe will remain stationary on rough roads or terrain.

Another object of the present invention is to provide a holder for pipes so that the pipes may be stored with the bowl down to prevent moisture from accumulating in the pipe stem.

A further object of the present invention is to provide a holder for pipes that may be secured in an area of a vehicle without direct exposure to the sun.

Still another object of the present invention is to provide a holder for pipes which may be used in a vehicle or in a home or office.

These and other objects and features of the present invention will be apparent from the following description and appended claims.

Briefly, the invention is a device, which attaches to a flat surface, for holding small objects. The device comprises a vertical surface and a horizontal surface which is secured to the vertical surface. The horizontal surface has one or more openings. An insert may be inserted into one of the openings and secured therein. A bottom opening in the insert is operable to secure any one of the small objects which is placed through the bottom opening. The device may comprise a plurality of openings in the horizontal surface and a plurality of inserts. One of the plurality of inserts may be secured within any one of the plurality of openings. Mounting means operates to secure the back of the vertical surface to the flat surface. The mounting means may comprise a plurality of double-adhesive mounting pieces. The double-adhesive mounting pieces have one adhesive side which secures to the back of the vertical surface and a second adhesive side which secures to the flat surface. The insert further comprises an upper lip extending beyond the opening in the horizontal surface and a ribbed outside surface. The ribbed outside surface is operable to press against the opening in the horizontal surface and to secure the insert in the opening. The bottom opening in the insert may be in the shape of the letter "X". The small objects secured within the device may be smoking pipes.

This invention will be more fully understood from the following detailed description and appended claims when taken with the drawings in which:

FIG. 1 is an isometric view of the pipe holder 1 with the pipe mounted with the bowl up and the stem down.

FIG. 2 is a view of the pipe holder 1 with insert 7 and adhesive mountings 5 and 6 exploded out from the pipe holder 1.

FIG. 3 is a top view of the insert 7.

Figure 4:
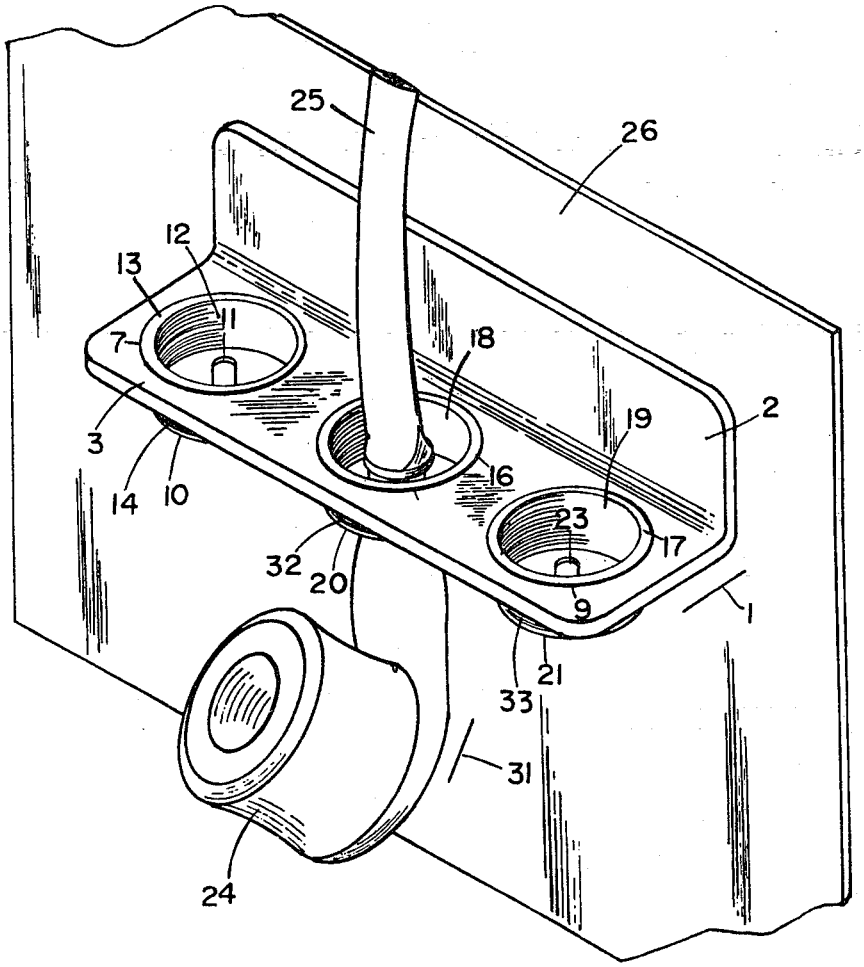
FIG. 4 is an isometric view of pipe holder 1 with the pipe mounted with the stem up and the bowl down.

Referring now to the drawings, FIG. 1 is an isometric view of pipe holder 1. Pipe holder 1 is mounted on a flat surface 26. Pipe holder 1 has a vertical surface 2 connected to a horizontal surface 3. In horizontal surface 3 are openings containing inserts 7, 8 and 9. Pipe 31 is secured into insert 8. Pipe 31 has a pipe bowl 24 and a pipe stem 25. FIG. 1 shows the pipe bowl mounted above the pipe stem 25. FIG. 4 shows the preferred use of the invention with the pipe stem secured above the pipe bowl. The invention may be utilized either way desired.

FIG. 2 shows double-adhesive mountings 5 and 6 exploded from pipe holder 1. Insert 7 is also exploded from pipe holder 1. Double-adhesive mounting 5 has an adhesive front surface 29 and an adhesive back surface 30. The adhesive front surface 29 adheres to the back 4 of vertical surface 2. The adhesive back 30 adheres to the flat surface 26. Double-adhesive mounting 6 has an adhesive front surface 27 and an adhesive back surface 28. Adhesive front surface 27 secures to the back 4 of vertical surface 2. Adhesive back surface 28 adheres to the flat surface 26. By the use of one or more double-adhesive mountings 5 or 6, the pipe holder 1 is secured to the flat surface 26.

Insert 7 has a bottom surface 10 with an "X" shaped opening. Insert 7 has an inside surface 12, ribbed outside surface 14 and an upper lip 13. Insert 7 is placed into opening 15 in horizontal surface 3 of pipe holder 1. The ribbed outside surface 14 helps to secure insert 7 within opening 15 of the horizontal surface 3 of pipe holder 1. The upper lip 13 of insert 7 prevents the insert 7 from falling through the opening 15 in horizontal surface 3. The "X" shaped opening 11 in bottom surface 10 enables objects, such as a pipe, to be extended through the "X" shaped opening. The bottom surface 10 is flexible. When the object, such as a pipe stem, is placed through the "X" shaped opening 11, the bottom surface 10 flexes to allow the stem through and then retracts to secure the stem in place. The flexible bottom surface 10 works to secure an object within the "X" shaped opening 11 whether the object is pushed through the "X" shaped opening 11 from above or below the insert 7. Insert 8 is placed into an opening (not shown) in the horizontal surface 3 of pipe holder 1. Insert 8 has an upper lip 16 which serves the same purpose as upper lip 13 of insert 7. Insert 8 has a ribbed outside surface 32 which functions the same as the ribbed outside surface 14 of insert 7. Insert 8 has a bottom 20 with an "X" shaped opening 22 which functions the same as the bottom 10 and the "X" shaped opening 11 of insert 7. Insert 8 has an inside surface 18.

Insert 9 is placed into an opening (not shown) in the horizontal surface 3 of pipe holder 1. Insert 8 has an upper lip 17 which serves the same purpose as upper lip 13 of insert 7. Insert 9 has a ribbed outside surface 33 which functions the same as the ribbed outside surface 14 of insert 7. Insert 9 has a bottom 21 with an "X" shaped opening 23 which functions the same as the bottom 10 and the "X" shaped opening 11 of insert 7. Insert 9 has an inside surface 19.

FIG. 3 shows a top view of insert 7. The pipe stem would be placed through the "X" shaped opening 11 in bottom surface 10. Bottom surface 10 is flexible and will open while the stem is being pressed through, and will then close and secure the stem when the stem movement ceases.

FIG. 4 is an isometric view of the pipe holder 1 showing the pipe 31 with the stem 25 above the pipe bowl 24. This is the preferred use of the present invention.

The pipe 31 is stored with the pipe bowl 24 down which prevents moisture from accumulating in the pipe stem 25. When moisture accumulates in the pipe stem 25, a bad taste for the pipe smoker can result. The present invention solves that problem by storing the pipe stem 25 above the pipe bowl 24, preventing moisture from accumulating in the pipe stem 25. The pipe holder 1 may be mounted on any flat surface. The pipe holder 1 may be mounted so that it is not in direct sunlight. When exposed to high temperatures, the pipe stem may lose its shape. The present invention may be mounted so as to minimize the high temperature possibility and to prevent the loss of shape of the pipe stem. The pipe holder 1 may be mounted anywhere that is convenient for the pipe smoker. The pipe holder 1 will adhere to any surface in a vehicle, home or office. The sun can also damage the pipe by tarnishing the stem, thereby giving the stem a bitter taste. The pipe stem can also discolor due to oxidation. By being able to mount the pipe holder 1 anywhere desired, the pipe smoker may prevent this possibility by mounting the pipe out of direct sunlight. Due to the flexible bottom of the inserts, the pipe stem may be secured within the pipe holder. The pipe will then remain stationary on rough roads or terrain.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device, which attaches to a flat surface, for holding small objects comprising:

a. a vertical surface;

b. a horizontal surface physically secured to said vertical surface, said horizontal surface being constructed in a single solid piece on one plane;

c. an opening in said horizontal surface;

d. an insert operable to be secured within said opening in said horizontal surface, wherein said insert comprises an upper lip extending beyond said opening in said horizontal surface, and a ribbed outside surface comprising a plurality of ribs, extending below said horizontal surface, operable to press against said opening in said horizontal surface and to secure said insert in said opening; and e. a bottom opening in said insert operable to secure any one of said small objects which is placed through said bottom opening;

wherein the depth of said bottom opening below said horizontal surface is adjustable by moving said insert vertically, wherein said insert is secured to said horizontal surface by different ribs of said plurality of ribs depending on the depth of said insert.

2. A device according to claim 1 wherein said device comprises a plurality of openings in said horizontal surface and a plurality of inserts, one of said plurality of inserts being operable to be secured within any one of said plurality of openings in said horizontal surface.

3. A device according to claim 1 further comprising mounting means operable to be secured to the back of said vertical surface and to said flat surface in order to secure said device to said flat surface.

4. A device according to claim 3, wherein said mounting means comprises a plurality of double-adhesive mounting pieces which have one adhesive side which secures to said back of said vertical surface and a second adhesive side which secures to said flat surface.

5. A device according to claim 1 wherein said bottom opening is in the shape of the letter "X".

6. A device according to claim 1 wherein said small objects are pipes.

7. A device according to claim 6 wherein one of said small objects is a pipe and said pipe can be secured to said device by placing the pipe stem of said pipe through said bottom opening where said pipe stem is secured within said insert, with the pipe bowl of said pipe thereby secured below said bottom opening in said insert and below said horizontal surface.

8. A device according to claim 2 wherein said small objects are pipes and wherein said pipes can be secured to said device by placing the pipe stems of said pipes through said bottom opening of each of said plurality of inserts where said pipe stems are secured within said plurality of inserts, with the pipe bowls of said pipes thereby secured below said bottom opening of each of said plurality of inserts below said horizontal surface.

* * * * *